US005118305A

United States Patent [19]

Hell et al.

[11] Patent Number: 5,118,305

[45] Date of Patent: Jun. 2, 1992

[54] TERMINAL BLOCK FOR A CABLE TERMINAL UNIT

[75] Inventors: Erich Hell, Dietrich-Bonheffer-Strasse 79, D-5608 Radevormwald; Hans-Dieter Otto, Wipperfürth; Horst-Helmut Tenham, Wuppertal; Joachim Rott, Berlin, all of Fed. Rep. of Germany

[73] Assignee: Erich Hell, Fed. Rep. of Germany

[21] Appl. No.: 701,589

[22] Filed: May 15, 1991

Related U.S. Application Data

[63] Continuation of Ser. No. 358,963, May 30, 1989, abandoned.

[30] Foreign Application Priority Data

May 31, 1988 [DE] Fed. Rep. of Germany ..... 3818497

[51] Int. Cl.[5] ..... H01R 4/24

[52] U.S. Cl. ..... 439/396; 439/417

[58] Field of Search ..... 439/395–407, 439/417, 418, 419, 438–441, 709, 723

[56] References Cited

U.S. PATENT DOCUMENTS 4,533,196 8/1985 Fordberg et al. ..... 439/404
4,547,034 10/1985 Fordberg et al. ..... 439/406
4,768,976 9/1988 Gelati ..... 439/441
4,781,618 11/1988 Geib et al. ..... 439/392
4,822,298 4/1989 Gerke et al. ..... 439/417

FOREIGN PATENT DOCUMENTS 3122303 1/1983 Fed. Rep. of Germany ..... 439/418
2516711 5/1983 France ..... 439/391

*Primary Examiner*—David L. Pirlot
*Attorney, Agent, or Firm*—Sughrue, Mion, Zinn, Macpeak & Seas

[57] ABSTRACT

A terminal block for a cable terminal unit comprises an insulating body which has receiving apertures in which in each of which a respective clamp is inserted which consists of a terminal contact and a separation and/or clamping device. The terminal contact is formed integrally with the separation and/or clamping device and at least one guide surface is provided for a wiring tool. With this construction it is possible to employ for wiring a single-strut wiring tool such as for example a common screw driver, whereby cost savings and operational simplifications may be achieved. Moreover, the terminal block has the advantage of simple and functionally reliable construction.

9 Claims, 7 Drawing Sheets

TERMINAL BLOCK FOR A CABLE TERMINAL UNIT

This is a continuation of application Ser. No. 07/358,963 filed May 30, 1989 now abandoned.

The present invention relates to terminal blocks e.g. for cable terminal units.

Such a terminal block is for example known from EP-A-020083. This comprises an insulating body which consists of a lower part and an upper part, in which receiving apertures are provided. In the receiving apertures, terminal contacts are arranged, each having a respective contact slot. Furthermore, the terminal block comprises separating devices in the form of cutting blades each of which is assigned to a respective terminal contact and serves for severing protruding lengths of the wires to be connected.

Although the terminal block constructed in this way has proved itself in practice, it is capable of improvement in that its construction is still relatively expensive. This is because the cutting blades are separately mounted in the insulating body and as a result of the special construction of the terminal contacts and their arrangement in relation to the cutting blades a specially constructed so-called two or multi legged wiring tool is necessary in order to establish contact with the connection wires in the terminal block. This wiring tool has a special construction so that its manufacturing costs are not insignificant.

It is therefore an object of the present invention to provide a terminal block whose construction is simplified and which enables the use of a commonly used tool as a wiring tool.

According to one aspect of the invention, there is provided a terminal block comprising:

an insulating body having receiving apertures; terminal contacts arranged in the receiving apertures and having contact slots;

separation and/or clamping devices integral with respective terminal contacts; and at least one guide surface for guiding a single-strut wiring tool.

As result of the integral construction of the terminal contacts and the separating and/or clamping devices, first of all simplification of the terminal block is achieved since separate receiving apertures for the separating devices are no longer required.

Furthermore, the terminal contacts and the separating and/or clamping devices can be manufactured in one working step which both reduces the manufacturing costs and also the assembly costs since in the course of arranging the terminal contacts naturally the separating and/or clamping devices can be inserted simultaneously into the terminal block.

Moreover, the terminal block according to the invention has the advantage that for example a screw driver or a similarly constructed push rod can be employed as wiring tool for which purpose corresponding guides for such a single-strut wiring tool are provided on the terminal block and/or on the terminal contact. By means of the guides and as a result of the resilient deflection of the terminal contact in front of the screw driver, it is achieved that the screw driver or the single strut wiring tool can be guided along the contact by the operator independently of his skill in such a manner that the wire is connected and if necessary cut. The deflecting terminal contact or the corresponding component here encounters limited freedom in the insulating body which prevents deformation of the limb or the complete terminal contact. This provides the special advantage that the multi-strut, relatively expensively constructed, wiring tool which had to be employed in previously known terminal blocks need no longer be used in the terminal block according to the invention.

Rather, the terminal block according to the invention is so constructed that in the course of insertion of the connection wire by means of a single-strut wiring tool both contacting of the unstripped wire takes place and also possibly any protruding wire length is cut off.

Expediently, a clamp-like construction of the separation and/or clamping device and of the terminal contact provides the advantage of particularly simple manufacture which is economic.

As result of a preferred resilient arrangement of the separation and/or clamping device on the terminal contact, it is advantageously achieved that in the course of the contacting the connecting wire, the separation and/or clamping device or the contact is deflected whereby a tension force is exerted on the clamped and notched wire (notched e.g. in the separation device) which in the corresponding embodiments leads eventually to separation of the protruding wire lengths.

A particularly advantageous construction for the separation device is a blade slot in a limb of the clamp, since this represents a simple construction of the separation device.

In order that the unit formed of the separating device and the terminal contact is easily accessible in the installed condition, the blade slot and the contact slot may be so arranged that they open upwardly in the installed condition.

In order to achieve clean separation, the lower end region of the separation device or the blade slot may be arranged higher than the lower end region of the contact slot so that even after a relatively short insertion path of the wiring tool sufficient tension force can be exerted for separating the protruding wire length. This produces in particular the advantage that contacting and separation can be performed very quickly and precisely.

A particularly easy and exact separation is achieved if the blade slot is constructed to have a conical taper.

In a preferred embodiment having a clamp constructed of a separation device and terminal contact, the guide surface for the single-strut wiring tool can be arranged on the separation device, whilst the guide surface faces the terminal contact.

In order advantageously to simplify insertion of the wiring tool in this construction, a guide region may upwardly adjoin the blade slot and the contact slot, and widen conically.

Furthermore, advantages result if the receiving recess of the insulating body has a bearing surface on which the separation and/or clamping device can abut in the course of contacting and separation and/or clamping of the wire after execution of a certain withdrawal movement. This stabilises the clamp and prevents undesired buckling of the same during contacting and separation or clamping. This is particularly important and advantageous with use of a single-strut wiring tool, since this itself provides no supporting effect for the terminal contact or the separation and/or clamping device.

In an alternative embodiment, a clamping device can be provided for example in the form of a clamping slot.

In such an embodiment, a sprung gripping and contacting clamp results which has the clamping slot on one side and has the contact slot on the other side. In this connection, during insertion of the wire this is fixed in the clamping slot and contacted in the contacting slot, whereupon the yield point of the securely clamped wire is exceeded upon increasing insertion depth of the wiring tool, so that the wire breaks.

The embodiment with clamping slot furthermore has the particular advantage that it simultaneously operates as a tension release slot for the contacted wire, so that tension forces and vibrations exerted on the wire in operation do not effect the quality of the contact.

In the above mentioned embodiment with the clamping slot and blade edge, the guide surface for the wiring tool is arranged on a side of the terminal contact facing a neighbouring wall of the terminal block. In this connection, the oppositely lying wall of the insulating body of the terminal block has a surface which together with the guide surface of the terminal contact defines in the installed condition a conically extending receiving chamber. The dimensions of the chamber are here adapted to that of the single-strut wiring tool to be employed in such a manner that on the one hand the single-strut wiring tool, i.e. the screw driver, can be easily inserted by the operator independently of his skill between the chamber and the insulating body and on the other hand the chamber, although resiliently deflecting, nevertheless provides stabilisation for the insulating body after the deflection. In this way, on the one hand contacting of the wire in the terminal contact is securely achieved and on the other hand stabilisation of the clamp is effected whilst preventing buckling of sections of the same in spite of the necessary application of the forces necessary for separating and/or clamping the wire.

In a further possible variation of the clamping and contacting unit, the conically tapering wall of the insulating body can be replaced by a further clamping member which is integrally connected to the clamping and contacting unit and moreover can additionally have an edge which further simplifies secure clamping of the protruding wire lengths.

As a particularly simple embodiment for the wiring tool, which can be used as a result of the special construction of the terminal block according to the invention, any commonly available screw driver or similar conically tapering push rod may be employed. This provides the particular advantage that no costs need be incurred for a specially constructed wiring tool so that the contacting and separating process can be performed at any time with conventionally used screw drivers.

Further details, features and advantages of the present invention will appear from the description of exemplary embodiments with reference to the drawing, in which.

Before the embodiments of the invention are described in detail, it is remarked that in the following the same reference numerals are employed for the same or corresponding parts but are provided in the various embodiments with index marks.

Moreover, it is to be noted that for reasons of simplification only parts of the terminal block according to the invention are shown. In the practical embodiment, this consists of a plurality of parts to be described in the following. For completeness of the description, reference is therefore expressly made to the disclosure of EP-A-0200883 which describes all parts in detail which are used also in the terminal block according to the invention, there being of course differences, which will be described in detail in the following, arising from the construction according to the invention.

Figure 2:
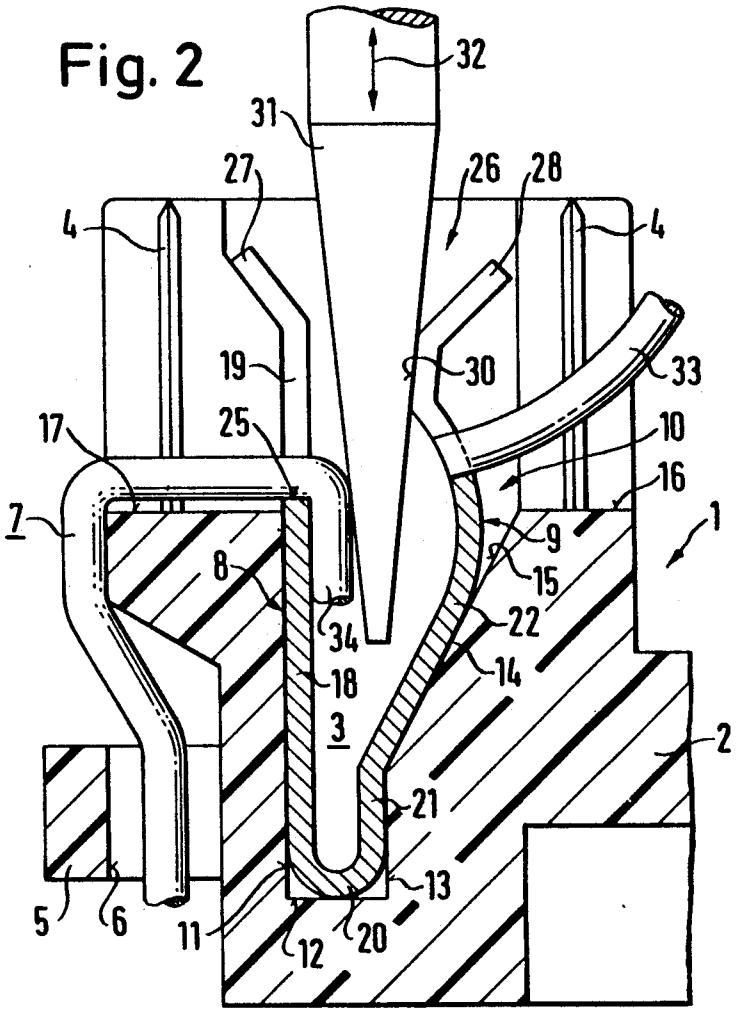
FIG. 2 shows a representation of the terminal block according to FIG. 1 during the contacting process.
Figure 1:
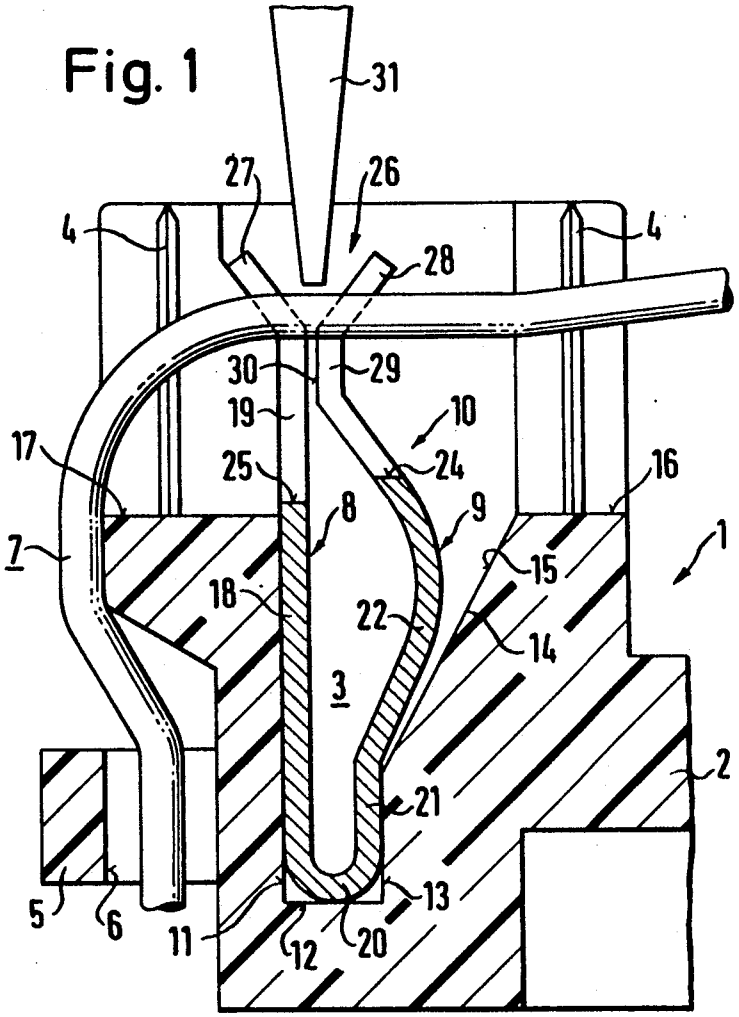
FIG. 1 shows a schematic and slightly simplified representation of a section through a part of a terminal block.

In FIGS. 1 and 2, a terminal block designated as a whole with the reference character 1, is illustrated for a cable terminal unit which is not illustrated in detail. The terminal block 1 has an insulating body 2 which is provided with receiving recesses 3. The insulating body 2 is thus constructed substantially in a U shape. On its upper peripheral edges are provided clamping ribs 4. Furthermore, the insulating body 2 is provided with a projection 5 which has an insertion aperture 6. Through the insertion aperture 6 wires 7 to be connected can be introduced as may be taken in detail from FIGS. 1 and 2.

Furthermore, FIGS. 1 and 2 show that the terminal block 1 has a terminal contact 8 and a separation device 9. The terminal contact 8 and the separation device 9 are formed integrally and together form an elastically resilient clamp 10.

Each clamp 10 is arranged in the associated receiving aperture 3 of the insulating body 2. The receiving aperture 3 has in detail a boundary wall 11 extending according to the selected illustration in FIGS. 1 and 2 on the left side substantially perpendicularly to the base surface of the insulating body 2, a base wall 12 adjoining the boundary wall at right angles and a wall member 13 in turn adjoining the base wall at right angles. The wall member 13 merges at an obtuse angle upwardly into a wall region 14 which forms a bearing surface 15 facing the receiving aperture 3. The function of this bearing surface 15 will be described in more detail in the following. At the other end of the boundary wall 11 or the wall region 14, in the installed condition, substantially horizontally extending surfaces 16 and 17 respectively adjoin from which the clamping ribs 4 extend perpendicularly.

As furthermore appears from the representation of FIGS. 1 and 2, the terminal contact 8 has a straight flat limb 18 which is provided in its upper region with a contact slot 19. This contact slot 19 serves for stripless contacting of the wire 7.

In the lower region, the limb 18 is integrally connected to a U-shaped arcuate connection member 20. The connection member 20 is connected at its lower end likewise integrally with a flat limb member 21 extending parallel to the limb 18, which member 21, as with the parts yet to be mentioned, is a component of the separation device 9. A convexly outwardly curving region 22, on the other upper end of which a blade slot 23 is provided, upwardly adjoins the limb part 21 according to the view selected in FIGS. 1 and 2. As is clear from FIGS. 1 and 2, the lower end region 24 of the blade slot 23—according to FIG. 3—is arranged higher than the lower end region 25 of the contact slot 19. Furthermore, it may be seen that in the installed condition, the blade slot 23 and the contact slot 19 open upwardly so that they are easily accessible.

Finally, FIGS. 1 and 2 make it clear that a conically widening guide region 26 upwardly adjoins the contact slot 19 and the blade slot 23. In the illustrated embodiment, the guide region 26 is formed from two limb parts 27 and 28, which are integrally arranged on the limb 18 and the arcuate region 22 respectively.

In this connection, between the limb part 28 and the arcuate region 22, is arranged an intermediate section 29 extending parallel to the limb 18. This section 29 has on its side facing the limb 18 a guide surface 30, which is arranged therefore on the separation device 9. This guide surface 30 serves for guiding a single-strut wiring tool 31, which for example can be a common screw driver with conically tapering side surfaces. Such a wiring tool 31 is illustrated in FIGS. 1 and 2, also in a slightly schematically simplified form.

From the combined disclosure of FIGS. 1 and 2, the mode of operation of the terminal block 1 during the process of making contact with the wire 7 is made clear. The wire 7 is guided through the insertion aperture 6 into the region of the contact slot 19 and the blade slot 23. As a result it comes to lie according to FIG. 1 with a part substantially horizontally in the insertion region 26. In this position, the limb 18 and the limb part 21 lie flat against the boundary wall 11 and the wall member 13 respectively, in contrast to which the curved region 22 adopts a certain spacing from the bearing surface 15.

If the wire is to be contacted, the wiring tool 31 is moved in the direction of the double arrow 32 downwardly towards the base of the receiving aperture 3. As appears clearly from FIG. 2, the wiring tool 31 thus presses the wire 7 with its left hand end into the contact slot 19 so that the insulation of the wire is penetrated and contacting takes place. During this process, the wiring tool 31 abuts the guide surface 30 of the separation device 9 with its corresponding surface. As a result of the conical construction of the tip of the wiring tool 31, the arcuate region 22, which is resiliently connected to the limb 18 via the limb part 21 and the connection member 20, deflects and is supported against the bearing surface 15. This stabilises the separation device 9 so that undesired buckling or deflection is prevented, although the wiring tool 31 itself cannot exert any stabilising effect on the clamp 10 since it is constructed exclusively with one strut. As a result of the pressing in of the wiring tool 31, furthermore the region of the wire 7 introduced into the blade slot is cut off so that the excess wire length 33 visible on the right hand side of FIG. 2 can be removed. This shearing off of the wiring length 33 is simplified by the higher arrangement of the lower end region 24 of the blade slot 23 relative to the lower end region 25 of the contact slot 19.

As furthermore as visible from FIG. 2, the wire end 34 of the contacted region of the wire 7 extending into the receiving aperture 3 is bent and thus abuts the inner side of the limb 18. This improves the retention of the wire 7 in the contact slot 19 so that the contact can be maintained even under the application of tensional loading.

After performing the contacting and separating process illustrated in FIG. 2, the wiring tool 31 is withdrawn in the direction of the double arrow 32 upwardly from the receiving aperture 3, whereupon the separating device 9 springs back again into its position illustrated in FIG. 1.

Figure 3:
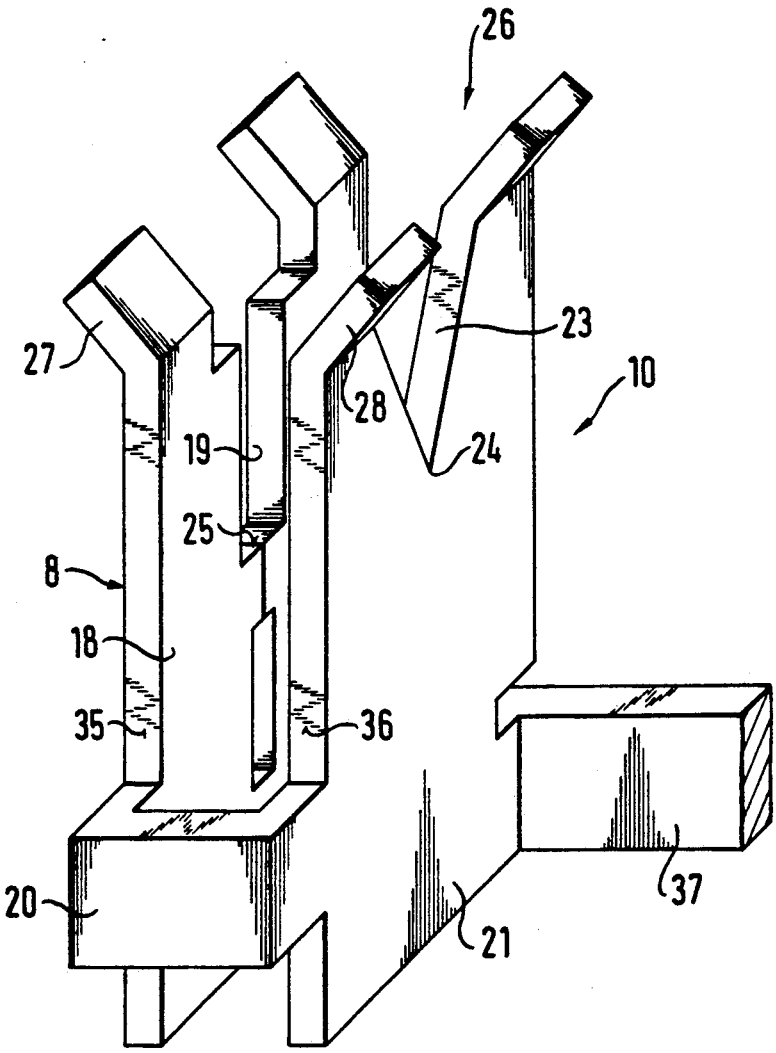
FIG. 3 shows a perspective representation of a variant of a terminal contact for use in the terminal block of FIGS. 1 and 2.

In FIG. 3, a modified clamp 10 is illustrated which basically also can be used in the terminal block 1 according to FIGS. 1 and 2. The separating device of the clamp 10 in FIG. 3 has in contrast to that of FIGS. 1 and 2 no outwardly arcuate region 22. The terminal contact 8 comprises in contrast the already described flat limb 18 parallel to which the flat limb part 21 extends. These two limbs 18 and 21 are likewise integrally connected together via the connection member 20. The U shaped connection member 20 is however here secured to two narrow sides 35 and 36 of the limb 18 or 21 lying in a horizontal plane. The securing regions of the connection member 20 on the narrow sides 35 and 36 lie in this connection somewhat above the lower edge of the limb 18 or 21 as appears in detail from FIG. 3.

Furthermore, it is also clear from this drawing that the contact slot 19 is formed wider in its upper end region and there merges into the limb part 27 of the insertion region 26.

The blade slot 23 is according to FIG. 3 V-shaped, the lower end region 24 of the downwardly conically converging blade slot 23 in turn lying higher than the end region 25 of the contact slot 19. Finally, the modified clamp 10 illustrated in FIG. 3 has a projection member 37 which comes to lie in a correspondingly constructed region of the terminal block 1.

Although the limb part 21 of the clamp 10 illustrated in FIG. 3 has no curved region, the receiving aperture 3 must, as a result of the resilient arrangement of separation device 9 and the terminal contact 8, likewise have an inclined bearing surface 15 onto which the limb part 21 can abut with its corresponding surface in the course of the introduction of the wiring tool 31 for stabilisation purposes.

Furthermore, FIG. 3 shows that the limb 18 is provided centrally with a separation slot proceeding from the end region 25 of the contact slot 19, which separation slot extends through the corresponding wall part up to a substantially rectangular aperture and serves for increasing the elasticity.

The spacing of the limbs 18 and 21 of the clamp 10 according to FIG. 3 can for example be less than 0.5 millimeters. As such, reference may be made for all further corresponding parts to the embodiments according to FIGS. 1 and 2.

Figure 5:
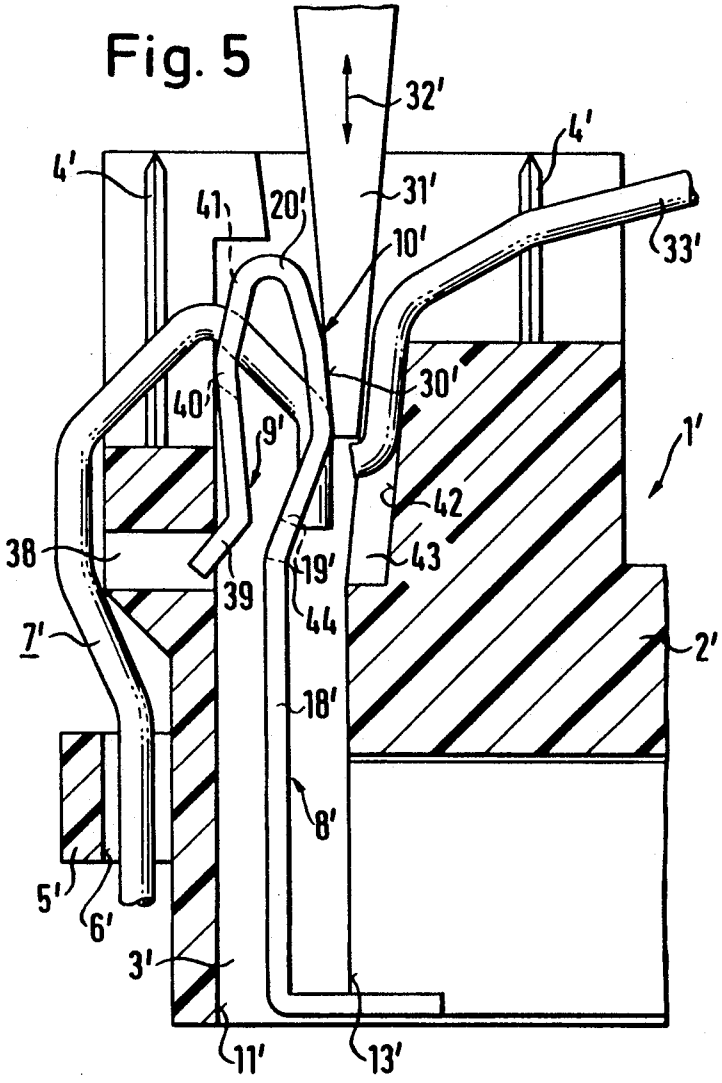
FIG. 5 shows a representation corresponding to that of FIG. 4 of the terminal block of the second exemplary embodiment during the contacting process.
Figure 4:
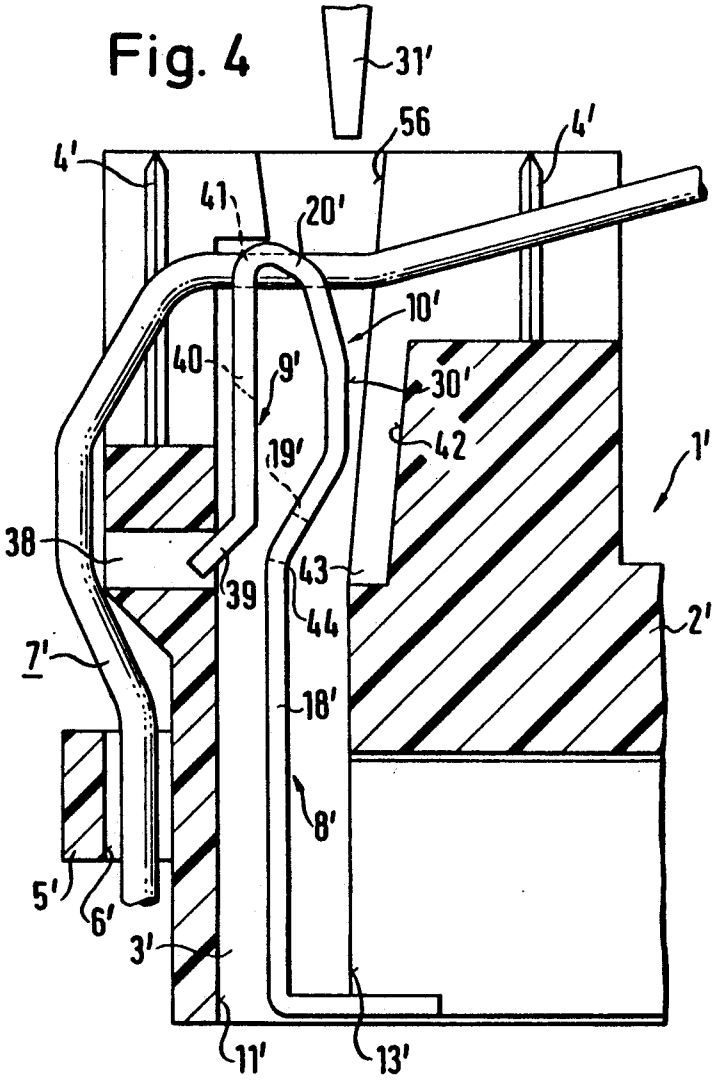
FIG. 4 shows a representation corresponding to that of FIGS. 1 and 2 of a second exemplary embodiment of the terminal block.
Figure 6:
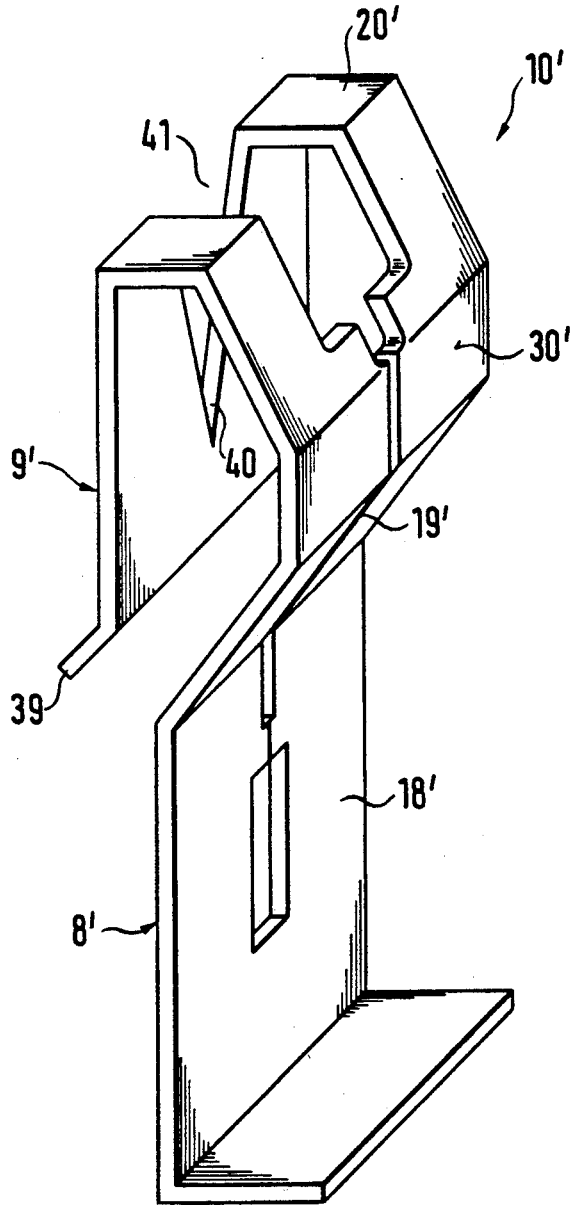
FIG. 6 shows a representation corresponding to FIG. 3 of a variant of a terminal contact for use in the embodiment according to FIGS. 4 and 5.

In FIGS. 4, 5 and 6 a second embodiment of a terminal block 1' according to the invention is illustrated.

The terminal block 1' comprises in turn an insulating body 2' in which is provided a receiving recess 3'.

The receiving recess 3' has in a lower section mutually parallel boundary walls 11', 13'. In the boundary wall 11', in a thickened region, an opening 38 is provided which is parallel to the base surface of the insulating body 2' and lies above the projection 5'.

As furthermore may be seen from FIGS. 4 and 5, within the recess 3' is arranged a clamp 10' which has terminal contact 8' and a clamp device 9' arranged integrally therewith. In this connection, the terminal 8' and the clamp device 9' are coupled together via an arcuate connection member 20'. In this embodiment, thus in a manner to be described in more detail, the wire is only clamped on the device 9', in contrast to the previously described arrangement in which the device 9' serves for actual separation of the wire.

The clamping device 9' has a projection 39 on its lower end whose free end extends into the opening 38 and serves for improved securing. Furthermore, the clamping device 9' has a clamping slot 40 which can preferably be constructed to taper conically downwards. The clamping slot 40 merges in its upper region into a guide opening 41 in the connection member 20'.

The terminal contact 8' has a longitudinally extending flat limb 18' in whose upper region a contact slot 19' is provided which likewise merges into the insert opening 41.

In this connection the contact slot 19' extends obliquely of the general direction of extension of the terminal contact 8' as such, whereby the contact limb of the contact slot 19' forms a torsion spring. For this purpose, the contact slot 19' is arranged in an inclined section adjoining a guide surface 30' as may be seen in detail in particular from FIG. 6.

The insert opening 41 itself extends from a horizontal flat region of the connection member 20' into an adjoining inclined flat section which is connected to the guide surface 30'. As may be seen from FIG. 6, the insert opening 41 narrows just above the transition into the guide surface 30', whereby an edge for removing the wire insulation is created lying in the installed condition parallel to the bottom surface of the insulating body 2'.

On the outer side of the guide surface 30', a wiring tool 31' can be applied if the wire 7' is to be contacted. For this purpose, furthermore a surface 42 lying opposite the guide surface 30' is provided on the insulating body 2'. This surface 42 is slightly inclined so that the guide surface 30' and the opposed surface 42 enclose a conically tapering receiving chamber 43 which is upwardly open.

For contacting the wire 7', it is first of all guided through the insert opening 6' into the region of the connection member 20' as may be seen in detail in FIG. 4. Thereafter, the single-strut wiring tool 31' (e.g. a screw driver) is guided downwardly in the direction of the double arrow 32' and makes contact with the guide surface 30'. As a result of the conical shape of the tip of the wiring tool 31' and the contact with the guide surface 56 of the insulating body 2', the terminal contact 8' is resiliently displaced, whereby the receiving chamber 43 is enlarged. In this connection, the wire 7' is introduced both into the clamping slot 40 and also into the contact slot 19' as may be seen from FIG. 5. As a result, the incoming end of the wire 7' is secured in the clamping slot 40, whereby in the contacted condition the advantage is achieved that the clamping slot 40 is simultaneously effective as a tension relieving slot for the contacted wire 7'. Furthermore, the wire 7' is contacted in the contact slot 19' by penetration of the insulation. As a result of the inclined position of the contact slot 19', an interlocking notch is produced by the edges of the contact tongues in the material of the wire extending at a slant somewhat parallel thereto, as a result of their torsional spring force.

As FIG. 5 further shows, as a result of further pressing in of the wiring tool 31', the wire is sheared since it is secured on the one hand in the clamping slot 40 of the clamping device 9' and on the other hand is clamped between the oppositely lying surface 42 and the corresponding surface region of the wiring tool 31'. Thus, the separated free end or the protruding wire length 33' can be removed from the terminal block 1' after the contacting and separation process.

From the combined illustration of FIGS. 4 and 5, it is furthermore clear that in the course of pressing in the wiring tool 31' the region of the limb 18' located beneath the receiving chamber 43 is separated from the wall 13' and at least approaches the left hand boundary wall 11' and possibly abuts against this. As a result, stabilisation of the clamping and contacting unit formed by the chamber 10' is achieved so that undesired buckling or displacement is securely prevented.

Figure 7:
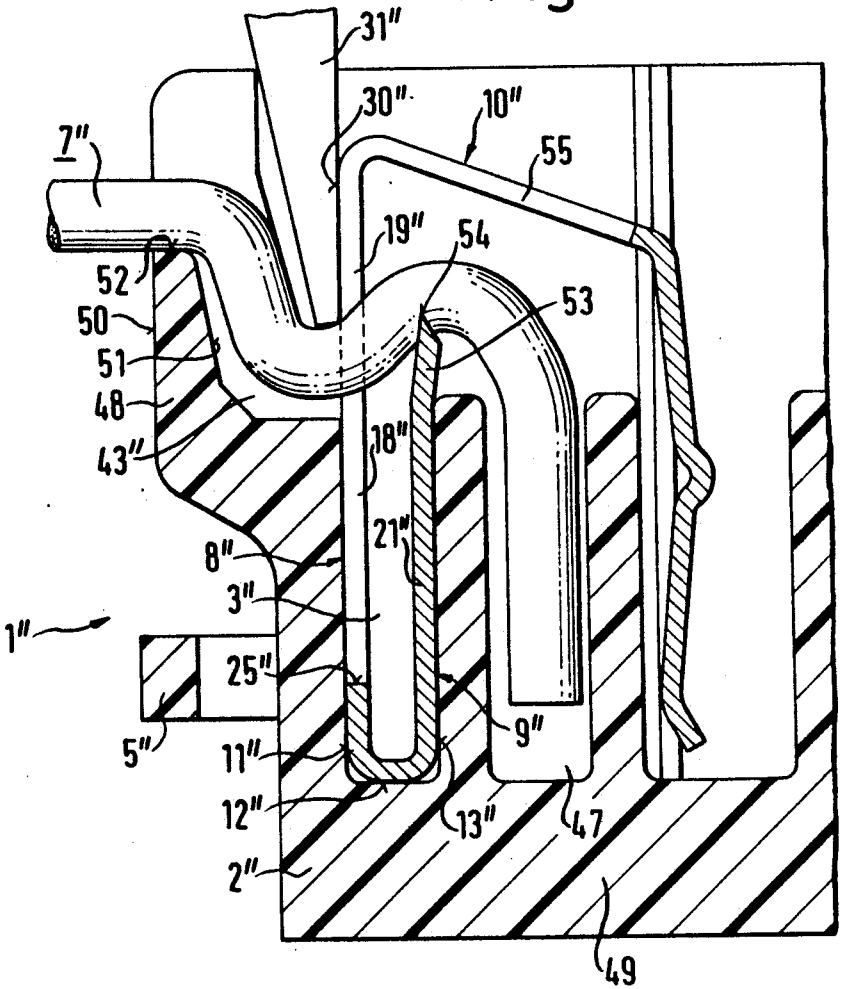
FIG. 7 shows a representation according to FIGS. 1 and 2 of a third embodiment of the terminal block during the contacting process.

In FIG. 7 a third embodiment of terminal block 1'' is illustrated. The terminal block 1'' comprises in turn an insulating body 2'' in which a receiving aperture 3'' is arranged. As may be seen from FIG. 7, the receiving aperture 3'' has a U-shaped section with parallel boundary walls 11'', 13'' which are coupled together via a bottom wall 12''. Adjacent this receiving aperture 3'' is arranged a pocket 47.

Insulating body 2'' furthermore has a rail 48 which is arranged above the projection 5'' and extends outwardly relative to a main region 49 of the insulating body 2''. The rail 48 has an outer wall 50 which extends substantially parallel to the boundary wall 11''. Its inner wall 51 includes an acute angle with the surface of the outer wall 50. The rail 48 furthermore has a bearing surface 52 which extends substantially parallel to the bottom surface of the insulating body 2'' between the outer wall 50 and the inner wall 51.

As may furthermore be seen from FIG. 7, in the receiving aperture 3'' in turn is arranged a clamp 10'' formed from a terminal contact 8'' and in this embodiment a clamping device 9''. The clamp 10'' is U-shaped in its region arranged below the receiving aperture 3'', a holding part 53 being arranged on a limb part 21'' of the clamping device 9'' above the aperture 3'', which holding part has a defined holding edge 54. Above the limb 18'' of the terminal contact is provided a contact 19'' whose lower end region 25'' is positioned lower than the holding edge 54.

Adjoining the contact slot 19'' is a substantially L-shaped extension member 55 which can be formed integrally with the limb 18''. The construction and arrangement of the extension member 55 can be seen in detail from FIG. 7. It can serve for further support of the clamp 10'' and for contacting of further terminals in the terminal block 1''.

On the side of the limb 18'' which faces the inner wall 51 of the rail 48 is provided a guide surface 30'' for a wiring tool 31'' which again can be constructed as a screw driver provided with a conical tip. The guide surface 30'' and the inner wall 51 delimit a receiving chamber 43''.

In FIG. 7, the condition is illustrated in which a wire 7" is introduced into the clamp and/or into the contact slot 19" of the terminal contact 8". This Figure illustrates that the wire 7" contacts the bearing surface 52 and is pressed into the receiving chamber 43" by the wiring tool 31". In this connection, a surface of the wiring tool 31" abuts the guide surface 30" as is shown in detail in FIG. 7. As a result, the unstripped wire 7" is contacted in the contact slot 19". The wire 7" is in this connection pressed onto the holding edge 54 and secured. In addition the free end is introduced into the pocket 47. In this embodiment, the wire to be connected is cut to length before contacting.

Since the clamping device 9" is arranged resiliently on the terminal contact 8", and since moreover the holding part 53 is slightly inclined relative to the limb part 21" in the direction of the pocket 47, during the clamping process the limb part 21" is pressed onto the wall member 13" and abuts against this. As a result, the clamp 10" experiences improved stabilisation as a result of which undesired displacement or buckling is again prevented. This is further improved by the abutment of the limb 18" on the elongate boundary wall 11" of the receiving aperture 3".

Figure 8:
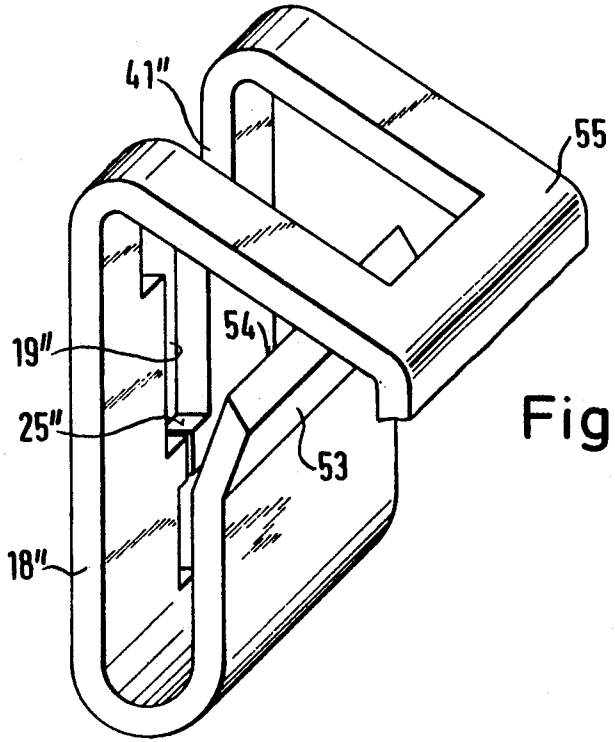
FIG. 8 shows a representation according to FIGS. 3 and 6 of a variant of a terminal contact for use in the embodiment of the terminal block according to FIG. 7.

In FIG. 8, the clamp used in the terminal block 1" according to FIG. 7 is illustrated again in perspective, the extension member 55 being only partially illustrated for improved clarity. From FIG. 8, in particular the position of the contact slot 19" in the limb 18" is made clear. Furthermore, it is illustrated that an insert opening 41" adjoins the upper region of the contact slot 19" and is of enlarged width relative thereto, the insert opening 41" extending also into the part of the extension member 55 directly adjoining the limb 18".

Figure 9:
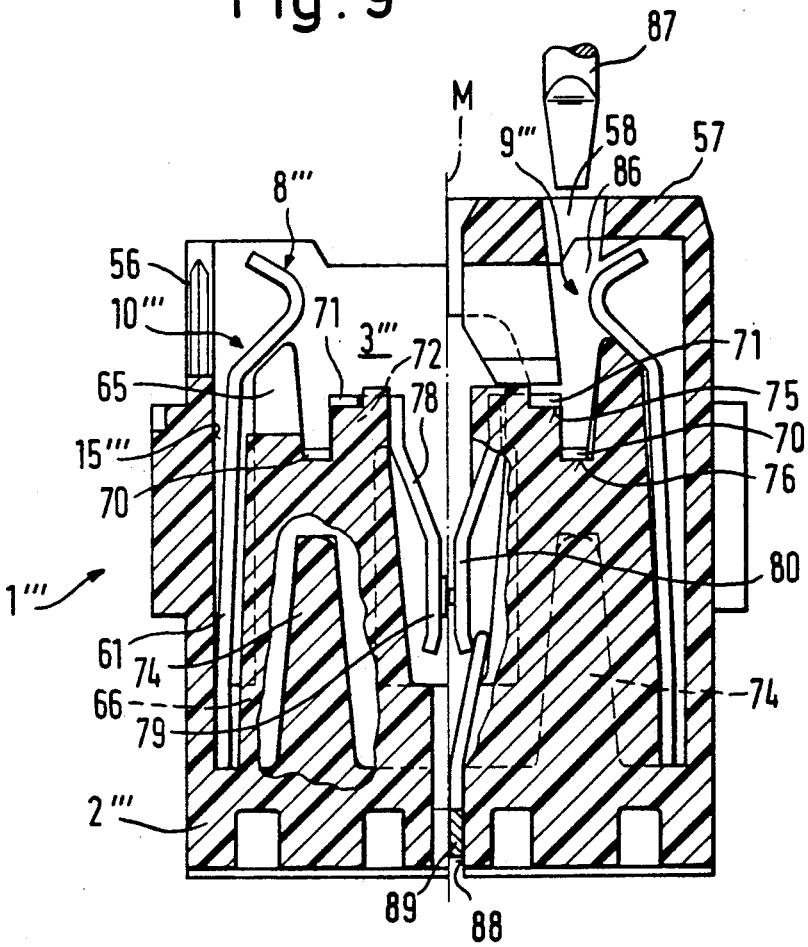
FIG. 9 shows a representation corresponding to FIGS. 1 and 2 of a fourth embodiment of the terminal block.

In FIG. 9, a fourth embodiment of a terminal block 1'" is illustrated. The terminal block 1'" has an insulating body 2'" which is provided with receiving apertures 3'". As in the proceeding embodiments, also the terminal block 1'" has a terminal contact 8'" and a separation device 9'" which are integrally constructed and together form an elastically resilient clamp 10'".

The clamp 10'" is arranged in the associated receiving aperture 3'" of the insulating body 2'". For this purpose, the receiving aperture 3'" is adapted to the special form of the clamp 10'" which can be seen in detail in FIG. 9. In this connection, the parts corresponding to the preceding embodiments are provided with indexed identical reference characters.

As is furthermore made clear in FIG. 9, the insulating body 2'" is constructed symmetrically with reference to the central plane M and has in its respective upper peripheral region insert openings for wires, of which the insert opening 56 is visible in FIG. 9. Above the insert opening 56 a respective hinged cover 57 is arranged for pivoting movement, the left hinged cover 57 in FIG. 9 being illustrated in the tilted away condition. For pivoting of the hinged cover 57 this can be provided with a suitable hinge or pivoting device on the insulating body 2'". In the hinged covers 57 are arranged insert openings of which insert opening 58 is illustrated in FIG. 9. Through the insert opening 58, a screw driver can be introduced into the insulating body 2'" for contacting and separation of a wire, as has already been described in detail with reference to the preceding embodiments of the terminal block according to the invention.

Figure 10:
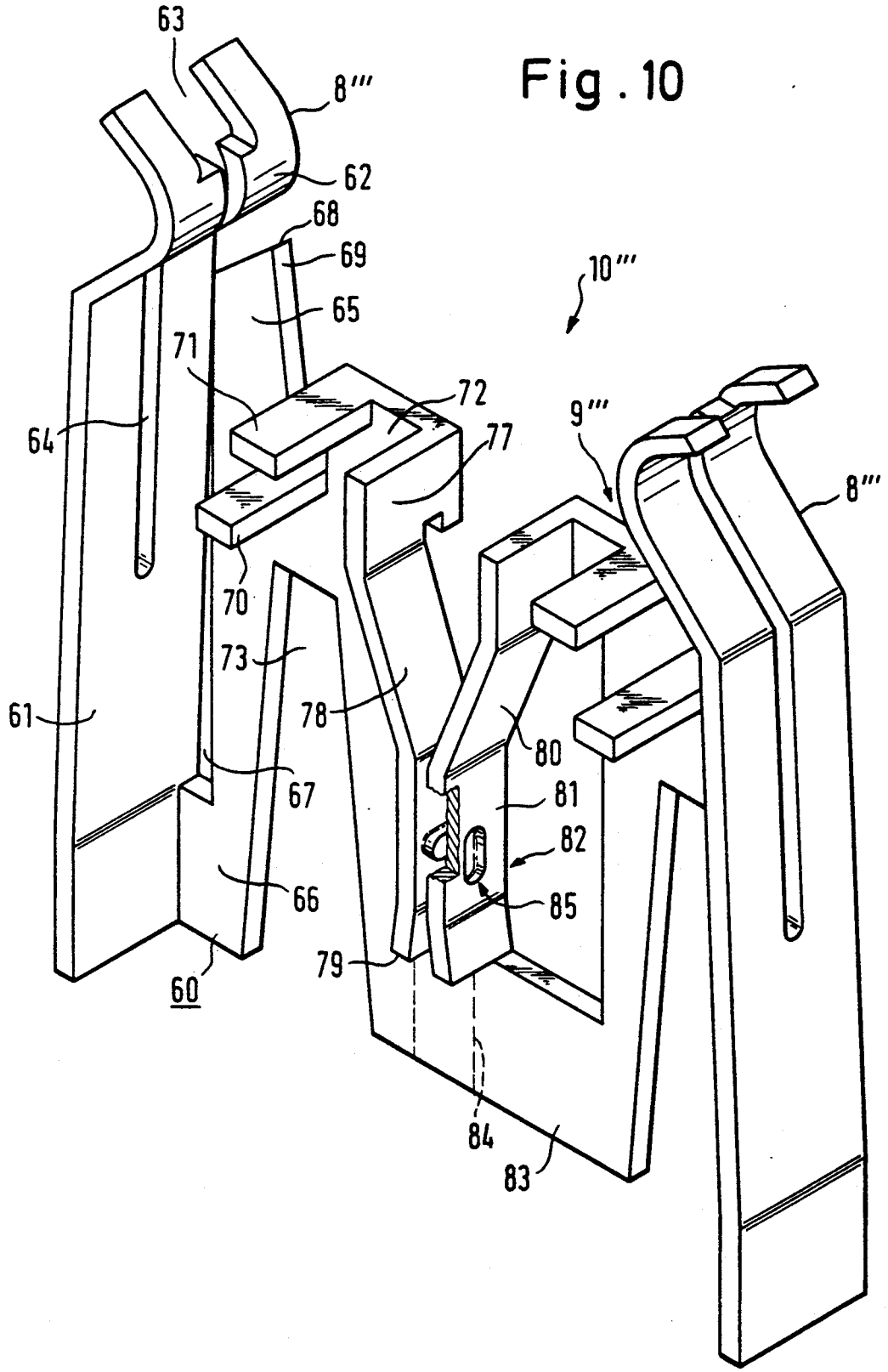
FIG. 10 shows a representation corresponding to FIG. 8 of a further variant for a terminal contact for use in the embodiment of the terminal block according to FIG. 9.

FIG. 10 shows the construction of the clamp 10'" in perspective view, from which it can be seen that also the clamp 10'" is formed symmetrically. Accordingly, the following description of one symmetrical half of the clamp 10'" applies also to the other symmetrical half.

In detail, the clamp 10'" has a plate shaped main part 60 on which the terminal contact 8'" is arranged substantially at right angles. The terminal contact 8'" is formed as a cutting and clamping contact which has a flat limb 61 which merges into an inwardly arcuate slightly V-shaped extension part 62. In the extension part 62 is arranged a substantially U-shaped insert opening 63 which merges into a cutting and clamping slot 64 which ends approximately in the middle of the limb 61.

Connected at right angles to the limb 61 is a contact and guide surface 65 which is arranged beneath the extension part 62.

As may be seen from FIG. 9, the contact and guide surface 65 is connected to the lower end region of the limb 61 via a connection section 66. Adjacently above the connection section 66 is a slot 67 which separates the upper part of the contact and guide surface from the limb 61 and which tapers upwardly to a point relative to the extension part.

The contact and guide surface 65 furthermore has two upper peripheral regions 68 and 69 mutually arranged at an acute angle. The peripheral region 69 merges into a stop strip 70 which is substantially rectangular and protrudes from the contact and guide surface parallel to the limb 61 from the contact and guide surface 65 in the same direction as the limb 61.

Above the stop strip 70 is provided a shearing strip 71. The shearing strip 71 protrudes in the same direction as the stop strip 70 and is arranged on a wall connection 72 which lies in the same plane as the contacting guide surface 65.

The step-like arrangement of the shearing strip 71 and stop strip 70 resulting from the above described arrangement is also visible in FIG. 9. Furthermore, it should be mentioned that the parts 61 and 65 to 72 of the clamp 10'" are integrally formed. In this connection, the stop strip 70 and the shearing strip 71 can be manufactured by bending. As the combination of FIGS. 9 and 10 shows, beneath the stop strip 70 is arranged a substantially inverted V-shaped recess 73 in the main part 60 of the clamp 10'" in which for positional securing a correspondingly shaped protrusion 74 of the insulated body 2'" engages when the clamp 10'" is inserted into the insulating body 2'". This arrangement is illustrated in FIG. 9.

Furthermore, the right half of FIG. 9 shows that according to the position of the stop strip 70 and the shearing strip 71 in the insulating body 2'" two shoulders 75 and 76 are formed on which the shearing strip 71 and the stop strip 70 respectively lie in the installed condition of the clamp 10'".

FIG. 10 furthermore shows that an integrally adjoining web 77 protrudes in the same direction as the shearing strip 71 substantially at right angles to the wall section 72, which web 77 again merges into a limb 78 which according to FIG. 9 runs into the central plane M at acute angle. On the limb 78 is arranged a further limb 79 lying substantially parallel to the central plane M. The limb 78 and 79 form according to the representation of FIG. 10 and together with the symmetrically arranged limbs 80 and 81 a separation contact 82 the upper region of which, bounded by the limbs 78 and 80, is V-shaped, whilst the limbs 79 and 81 extend substantially parallel and delimit a pocket. The contact limbs 79 and 81 carry respective perpendicular or horizontal contact beads which together form a rest contact. FIG.

10 illustrates in this connection that the limbs 79 and 81 are provided with an embossed contact 85.

Beneath the limbs 79 and 81 of the separation contact 82 is arranged a connecting wall section 73 in which a separator 84, illustrated in chain lines in FIG. 10, can be mounted. Such a separator or opening 84 can be manufactured by stamping out of the corresponding wall section which makes possible a through connection of the connected wires only through the two limbs 79 or 81 of the separation contact 82.

In the embodiment of the terminal block 1''' according to FIG. 9 if a wire is to be contacted, it is introduced into the interior of the insulating body 2''', whereupon a common screw driver is inserted through the opening 58. This can abut the contact and guide surface 65 and possibly neighbouring parts of the housing of the insulating body 2''' and in the course of being pressed down contacts the wire in the cutting and clamping slot 64. The excess length is separated by the shearing strip 71 because the V-shaped chamber 76 formed beneath the insert opening 58 in the insulating body 2''' provides sufficient space only for the single-strut wiring tool in the form of a screw driver 87 and not for the wire. FIG. 9 shows that the construction of the chamber 86 is such that it exactly fits the screw driver 87 so that the desired functioning is ensured.

Thus, in the embodiment according to FIGS. 9 and 10, the separation device is formed from the shearing strip 71 and the stop strip 70 which for forming the clamp 10' are likewise integrally connected to the terminal contact 8''' and permit the use of a simple screw driver as wiring tool. The additional separation possibility further widens the application possibilities of the embodiment according to FIGS. 9 and 10. As such, this embodiment likewise has all the advantages which have been explained already in connection with the remaining embodiments.

In the embodiment according to FIG. 9, furthermore on the lower side of the insulating body 2''' an opening 88 is provided for a contact position 89, e.g. an earth line. If needed, also a plurality of such openings can be provided.

We claim:

1. Terminal block comprising:

an insulating body having receiving apertures;

terminal contacts arranged in the receiving apertures and having contact slots;

separation and/or clamping devices integral with respective terminal contacts;

at least one separation and/or clamping device and associated terminal contact form a clamp;

said clamp having at least one guide surface for guiding a single-strut wiring tool;

said at least one separation and/or clamping device having a shearing member protruding from said guide surface; and a stop member being arranged in an inserting direction of said wiring tool beneath said shearing member, said stop member being substantially parallel to said shearing member, said stop member being in a step-like staggered arrangment relative to said shearing member.

2. Terminal block according to claim 1, wherein the stop member and the shearing member are bent from a main part of the clamp and protrude in parallel from the main part in the same direction as the terminal contact.

3. Terminal block according to claim 1, wherein the separation and/or clamping device and the terminal contact are arranged V-shaped to each other.

4. Terminal block according to claim 1, wherein on a lower side of the insulating body openings are provided for receiving a metallic connection bar or a disconnect plug.

5. Terminal block according to claim 1, wherein in the insulating body a chamber is arranged which adjoins an insert opening for the single-strut wiring tool and which is adapted in shape to the single strut wiring tool.

6. Terminal block according to claim 1, wherein the clamp is provided with a separation contact.

7. Terminal block according to claim 6, wherein the separation contact has two substantially parallel lower limbs which are adjoined upwardly in the direction of the shearing member by two substantially V-shaped limbs.

8. Terminal block according to claim 6, wherein the separation contact is integrally connected to a main part of the clamp.

9. Terminal block according to claim 7, wherein beneath the two lower limbs of the separation contact a well part is provided which is arranged in the plane of the contact and guide surface and in which a separation opening can be provided.

* * * * *

UNITED STATES PATENT AND TRADEMARK OFFICE

CERTIFICATE OF CORRECTION

PATENT NO. : 5,118,305

DATED : June 2, 1992

INVENTOR(S) : Erich Hell, Hans-Dieter Otto, Horst-Helmut Tenham, Joachim Rott

It is certified that error appears in the above-indentified patent and that said Letters Patent is hereby corrected as shown below:

On the title page: Item [73]

]73[ Assignee: Quante AG
Uellendahler Strasse 353
D-5600 Wuppertal 1
Federal Rep. of Germany Signed and Sealed this Twenty-second Day of March, 1994

*Attest:*

Bruce Lehman

BRUCE LEHMAN

*Attesting Officer*

*Commissioner of Patents and Trademarks*